United States Patent [19]

Ferrington

[11] 3,972,208

[45] Aug. 3, 1976

[54] PATTERNING CONTROL ARRANGEMENTS FOR KNITTING MACHINES

[75] Inventor: Leslie Joseph Ferrington, Leicester, England

[73] Assignee: Wildt Mellor Bromley Limited, Leicester, England

[22] Filed: Dec. 17, 1974

[21] Appl. No.: 533,475

[30] Foreign Application Priority Data

Dec. 20, 1973 United Kingdom ..... 59261/73

[52] U.S. Cl. ..... 66/50 R

[51] Int. Cl.[2] ..... D04B 9/00

[58] Field of Search ..... 318/39; 340/172.5; 66/50 R, 50 B, 154 A, 25

[56] References Cited

UNITED STATES PATENTS

| | | | |
|---|---|---|---|
| 3,470,714 | 10/1969 | Corbaz | 66/50 R |
| 3,745,791 | 7/1973 | Cuche | 66/50 R |

FOREIGN PATENTS OR APPLICATIONS

| | | | |
|---|---|---|---|
| 1,961,012 | 6/1971 | Germany | 66/50 R |
| 1,214,691 | 12/1970 | United Kingdom | 66/50 R |

*Primary Examiner*—Mervin Stein
*Assistant Examiner*—Andrew M. Falik
*Attorney, Agent, or Firm*—Irving M. Weiner; Pamela S. Burt

[57] ABSTRACT

One limiting factor on the speed of a circular knitting machine with individual pattern control of each needle is the time taken by the patterning devices to effect the change between knit and non-knit positions. The initiation of the change cannot take place, at low speeds, before a patterning actuator has cleared from a patterning butt. According to the invention, there is provided an arrangement whereby the actuation takes place from a trailing edge of a triggering pulse at low speeds and from a leading edge at higher speeds.

9 Claims, 8 Drawing Figures

PATTERNING CONTROL ARRANGEMENTS FOR KNITTING MACHINES

This invention relates to patterning control arrangements for multi-feed circular knitting machines of the type comprising a needle cylinder having needles accommodated in tricks therein, individually selectable patterning butts on or associated with each needle, the said patterning butts being divided into groups at spaced heightwise locations in relation to the needle tricks, and a number, equal to the number of groups, of pattern control means at each feed station with each pattern control means at a station being cooperable with the patterning butts of one group to engage or miss those butts to control the operation of the associated needle.

By dividing the patterning butts into groups in this way, each pattern control means cooperates only with a fraction of the total number of needles, i.e., $1/n$ where $n$ is the number of groups, for example, 4 or 6. This means that the time available for control and physical actuation of the pattern control means between successive selections is increased by a factor of $n$ and an actuator thereof may be brought into position before the patterning butt reaches it and not moved until well after the patterning butt has passed.

Normally, the patterning butts are arranged in a heightwise echelon formation and the cooperating ends of the actuators are arranged one above another.

The actuators of pattern control means for such machines are normally operated by electromagnetic devices, the actuator having a butt-engaging end arranged to be moved between butt-missing and butt-engaging positions. Control of the operation of each electromagnetic actuator is by circuitry arranged to provide actuating pulses in response to input pulses from a pattern input facility associated with the machine and adapted to provide the input pulses in a predetermined sequence. The pattern input facility may, for example, be a pattern control tape or band scanned electronically or photo-electrically, or even a pattern matrix of a computer, i.e., a pattern stored in a core store of a computer configuration. In the latter case, the pattern information may all be stored in the core store, or blocks of information may be temporarily stored therein for use as input information, while the whole of the pattern information is normally in a mass store external to the computer.

In operation, there is necessarily a measurable delay between the emission of the input pulses and the corresponding completion of the movement of the actuators to bring them to the selected butt-missing or butt-engaging positions. This is largely due to the time required for the physical change of position of each actuator. It is clear that this physical change of position must not commence before one butt has completed its movement past the actuator and must be completed before the succeeding butt reaches the actuator. At normal operating speeds of conventional knitting machines this time available for completing the change-over is a few milliseconds and to enable the physical change of position to be completed in time, the input pulse has to be advanced as far as possible to obtain the maximum operating speed. However, the machine must also operate accurately and correctly at low operating speeds to avoid pattern errors or machine damage during the time it is working up from and down to rest, so that in practice the input pulses cannot be timed ahead of clearance of the butts from the actuator since otherwise there would be a low operating speed at which incorrect operation would arise leading to errors and possibly to machine damage. This consideration puts a limitation on the maximum operating speed of the machine.

A typical example of such a pattern control means is disclosed in the specification of our United Kingdom Patent No. 1,214,691, for the control of a multifeed circular knitting machine provided, e.g., with 1728 needles and 36 feed points each having an associated group of 6 actuators. The control means is provided with a pattern input facility comprising a pattern band having 36 rows of information spots (holes or blanks) and a drum provided with 6 rows of holes in staggered formation from which a positive routing pulse is provided for appropriate ones of the actuators in each group of six thereof whereby, when the knitting machine is in use, a routing pulse in conjunction with pattern signals or otherwise from the 36 rows of information determines the positions of the actuators for operation, or otherwise, on the next in line series of patterning butts on the needle control elements.

The routing pulses associated with any one level of actuators in the groups thereof are timed to fall between the passage of the patterning butts past said actuators and thus, as hereinbefore disclosed, if the speed of rotation of the machine is increased beyond an optimum speed of the system a situation is reached where faulty fabric results from the inability of the actuators in function at sufficiently high speed to cater for the increased rotational speed of the machine.

Proposals have previously been made for instituting an advance in the operation of the actuator, in relation to a timing pulse system, when the operating speed of the motor is above a fairly low level, e.g., 3 r.p.m. These proposals have all involved fairly complex electronic arrangements, and have therefore been expensive to install.

It is an object of the present invention to provide a pattern control arrangement having an improved arrangement for advancing the operation of the actuator when the speed is above a predetermined minimum.

Accordingly, the present invention consists of a patterning control arrangement of the type described wherein the pattern control means each includes an electromagnetically-operated actuator controlled by circuitry arranged to provide operating pulses for the actuator in response to triggering pulses, in which the circuitry is arranged to initiate the operating pulses in response to the positive-going or negative-going edge of the triggering pulse, and in which the pattern control means includes inverter means for effectively inverting the triggering pulses at a predetermined speed of operation of the machine whereby the operating pulses are produced in response to the completion of the triggering pulses at operating speeds below the predetermined speed, and in response to the initiation of the triggering pulses at higher operating speeds.

The inverter means may actually invert the triggering pulses or it may comprise means to render the circuitry responsive to the opposite-going end portion of the pulse.

In a preferred embodiment of the invention, the operating pulses commence, in the higher machine speed range, when the actuator is opposite the previous patterning butt, and at lower speeds the operating pulses are produced when the previous butt has cleared the actuator.

The threshold or changes in speed may be in the region of 20 r.p.m.

The triggering pulses may conveniently be provided by a generator means for providing a fixed length triggering pulse for each actuator in timed relation to the speed of the machine.

The triggering pulses may be passed through an exclusive OR gate associated with each actuator, and in one mode of operation they may be passed directly from the generator as received. In the other mode of operation the triggering pulses may be combined with an output from an intermediate circuit arrangement which produces a signal when the speed of rotation of the machine is above the predetermined level, and this output has the effect of inverting the triggering pulses.

The intermediate circuit arrangement conveniently comprises an OR gate input to an integrator and trigger circuit responsive to the machine speed to generate an output only at machine speeds above a threshold, e.g., one-half to three-quarters, the designed machine speed.

The output from the exclusive OR gate may conveniently be a negative or positive pulse depending upon the machine speed, a triggering pulse direct from the generator appearing as an inverted negative pulse, and a triggering pulse plus an output from the intermediate circuit arrangement appearing as a positive pulse.

The circuitry may conveniently comprise a control interface whereby pattern input information from a computer configuration may be routed to the actuators of a knitting machine in accordance with the pulses received from the exclusive OR gates.

The control interface may conveniently be operatively responsive to positive-going edges of the pulses from the exclusive OR gates. Thus when a knitting machine is in use below one-half to three-quarters of its optimum designed speed, the control interface will trigger to provide a next actuator-operating pulse off the lagging end of an inverted input pulse thereto. Above one-half to three quarters speed of the machine, the control interface will trigger to provide a next actuator-operating pulse off the leading edge of a non-inverted input pulse thereto. Thus, the application of operating pulses to the actuators are effectively advanced at high speed by the width of the triggering pulse thereby giving more time for the actuator to function to make a selection while allowing an increase in machine speed to be effected.

The invention will be further described with reference to the accompanying drawings which illustrate a preferred embodiment of the invention.

Figure 5:
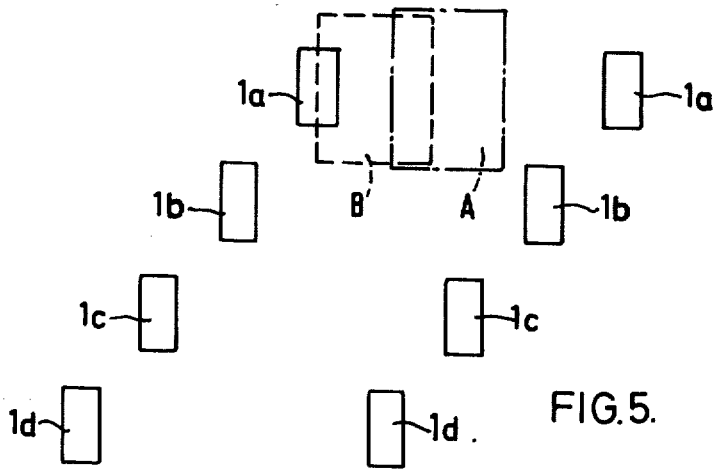
FIG. 5 shows diagrammatically the patterning butts of needle control elements together with zones of operation thereof depending upon the speed of the machine.
Figure 8:
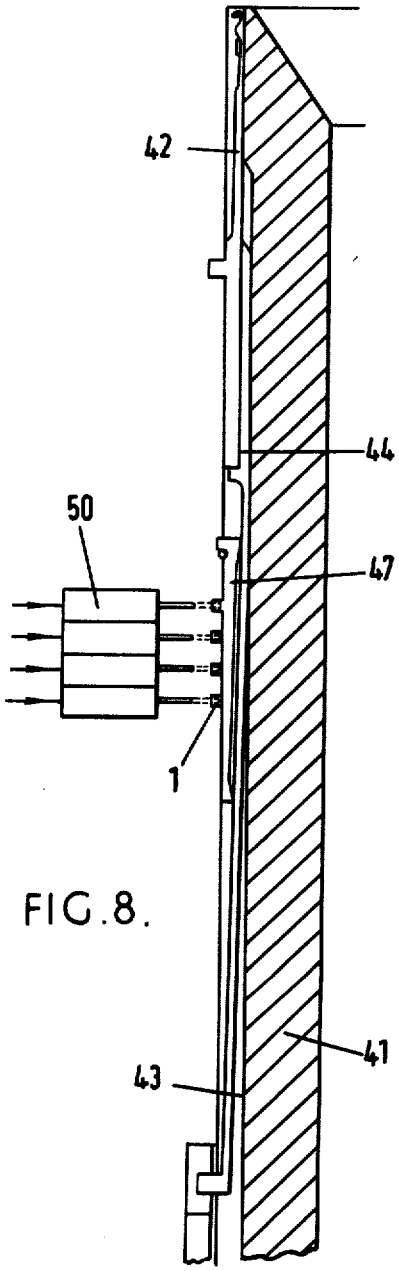
FIG. 8 is a diagrammatic section illustrating parts of a knitting machine per se.

A typical form of knitting machine to be controlled by the control arrangement illustrated is shown in FIG. 8 and comprises needles 42 (e.g., 1728 in number) slidably mounted in needle tricks 43 formed in a needle cylinder 41, yarn feed locations (e.g., 48 in number) each having an associated group of four actuators 50 arranged in a stack, and needle control elements provided by needle jacks 44 and needle pressers 47 located in the needle tricks beneath their respective needles 42. Each needle control element comprises a single patterning butt 1, the butts 1 being arranged in groups to be moved in a path past an associated one of said actuators, there being four such paths, one to each actuator stack height, and the butts 1*a*, 1*b*, 1*c* and 1*d* of adjacent needle jacks being arranged in echelon formation about the needle cylinder, as shown in the diagrammatic representation in FIG. 5.

The control arrangement comprises (see FIG. 1) a signal generator 2 connected by a signal line 3 to the knitting machine 4, the generator being responsive to the speed of the knitting machine, when in use, to produce four trains of initial triggering pulses of fixed length and positive polarity at the frequency of the needles passing a given point on the cylinder of the knitting machine. The signal generator may, for example, be a set of holes in a rotary drum similar to those described in our above mentioned specification United Kingdom Pat. No. 1,214,691, or it may take some other form.

Figure 2:
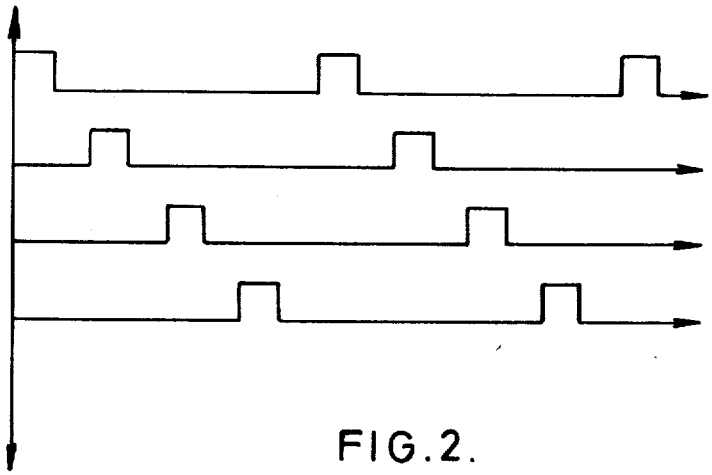
FIGS. 2 and 3 show graphically the triggering pulses for the control arrangement depending upon the speed of the knitting machine.

The four trains of initial triggering pulses, in the form shown in FIG. 2, are routed through lines 5, 6, 7 and 8 associated with the four actuators of one of the stacks of actuators (only one train of initial triggering pulses, associated actuators and circuitry will hereinafter be described for simplicity) to associated exclusive OR gates OR1, OR2, OR3 and OR4, respectively.

Figure 3:
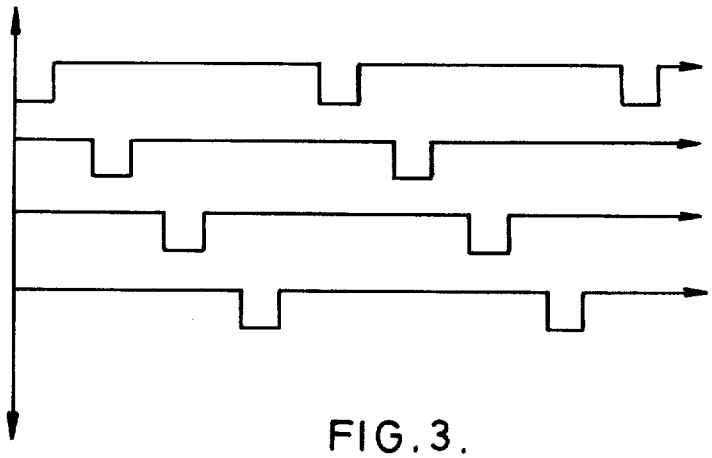

At rotational speeds of the knitting machine below one-half to three-quarters the optimum speed of the machine, e.g., below about 20 r.p.m., the output from each of the exclusive OR gates OR1, OR2, OR3 and OR4, will be inverted pulses as shown in FIG. 3, which are then fed via lines 9, 10, 11 and 12 to a control interface 13. Interface 13 provides the link between the computer 16 and the knitting machine 4, and comprises a 4 to 1 multiplexor having four input serial pulse trains coming in over lines 9, 10, 11 and 12 and provides a single output serial pulse train on line 17. The interface 13 also includes amplifiers to enable pattern data signals from the computer 16 via the line 18 to drive the actuators 50 through the line 19. However, this is all standard equipment. For example, the aforementioned amplifier may take the form as that shown in FIG. 18 of a standard manual of Louis Newmark Limited entitled "Pattern Control Equipment", which is incorporated herein by reference thereto.

Figure 4:
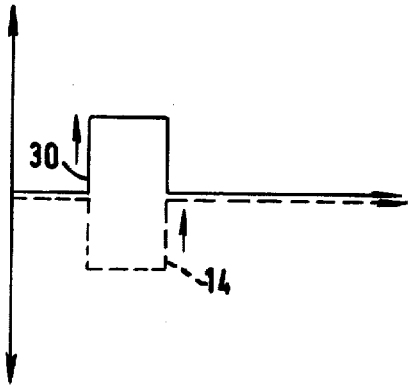
FIG. 4 shows graphically the difference in phase of operation of a control interface at high and low speeds of the machine.

As can be seen in FIG. 4, the inverted signal shown in dotted lines has a positive-going lagging edge 14 which is utilized to trigger the operation of the interface 13 and to cause accessing of a computer 16 through a line 17, whereupon pattern information from the core store of the computer 16 is fed via a line 18 to the control interface 13 and then in correct sequential relationship via lines 19 (only one of which is shown) to appropriate ones of said actuators on the machine 4 depending on the pattern repeat around the machine cylinder.

Figure 6:
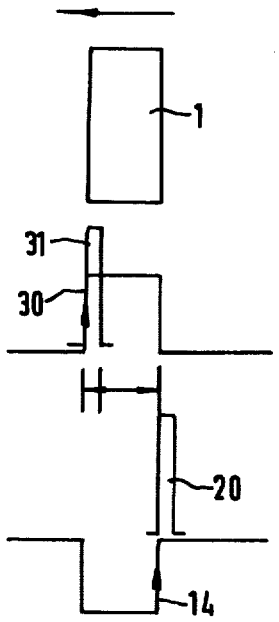
FIG. 6 shows diagrammatically the phase difference between actuator-operating pulses in relationship to a patterning butt passing an actuator.
Figure 7:
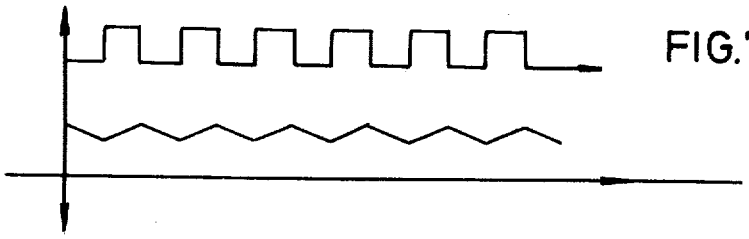
FIG. 7 illustrates the d.c. ripple output from an integrator of the control arrangement.

As stated hereinbefore, the control interface 13 is triggered by the positive-going lagging edge 14 of the inverted signal and provides an amplified operating pulse 20 of shorter duration (see FIG. 6), the pulse 20 being created just after a patterning butt 1 has effectively passed by the associated actuator. Thus it will be appreciated that at low speeds of the machine, e.g., below about 20 r.p.m., the pulses are effective in the chain dotted line area A on FIG. 5 to cause a pattern butt-engaging end of the actuator to move into, or from, a pattern butt-engaging position whereby a knit or non-knit function of a needle element associated with the pattern butt is effected.

The outputs of the signal generator 2 are also fed via lines 21, 22, 23 and 24 to an OR gate OR5 and then as a cumulative input via a line 25 to an integrator 26 the output of which is a rippled d.c. voltage as shown in FIG. 77. The mean value of the d.c. voltage is proportional to the machine speed. The d.c. output is fed from the integrator 26 to a Schmitt Trigger Device 27 which is manually set, by means shown diagrammatically at 28, to fire when the voltage level of the D.C. input thereto is such that the speed of the machine is in excess of 20 r.p.m.

When the device 27 fires as aforesaid, the exclusive OR gates OR1, OR2, OR3 and OR4 give non-inverted outputs via the lines 9, 10, 11 and 12 to the interface 13 as shown in full lines in FIG. 4.

The control interface 13 is now triggered off the positive-going leading edge 30 of each non-inverted positive pulse (see FIG. 6), an amplified operating pulse 31 being created in phase with the passage of a patterning butt 1 past the associated actuator. It will be appreciated, therefore, that at high speeds of the machine, i.e., above 20 r.p.m., the next in line sequence of such knit or non-knit pulses are effective in the dotted line area B on FIG. 5, which area is in advance of the area A by the width of the triggering pulse generated by the signal generator 2. Thus, the time at which a next in line series of pattern pulses is provided in respect of the passage of needle control elements past actuators, is advanced to such effect that the optimum speed of the machine may be increased by some 30 to 40 per cent.

The integrator 26, or that portion of the speed sensing circuit associated therewith, may conveniently incorporate a hysteresis effect of approximately 2 seconds to avoid any tendency to oscillate should the machine be running at the change over speed of 20 r.p.m.

The triggering pulse generated by the signal generator 2 is utilized as described herein to determine the amount of advancement of the operating pulses at high speeds of the machine. Thus, it will be apparent that by varying the length of the triggering pulses from the signal generator 2, the amount of such advancement can be varied.

Figure 1:
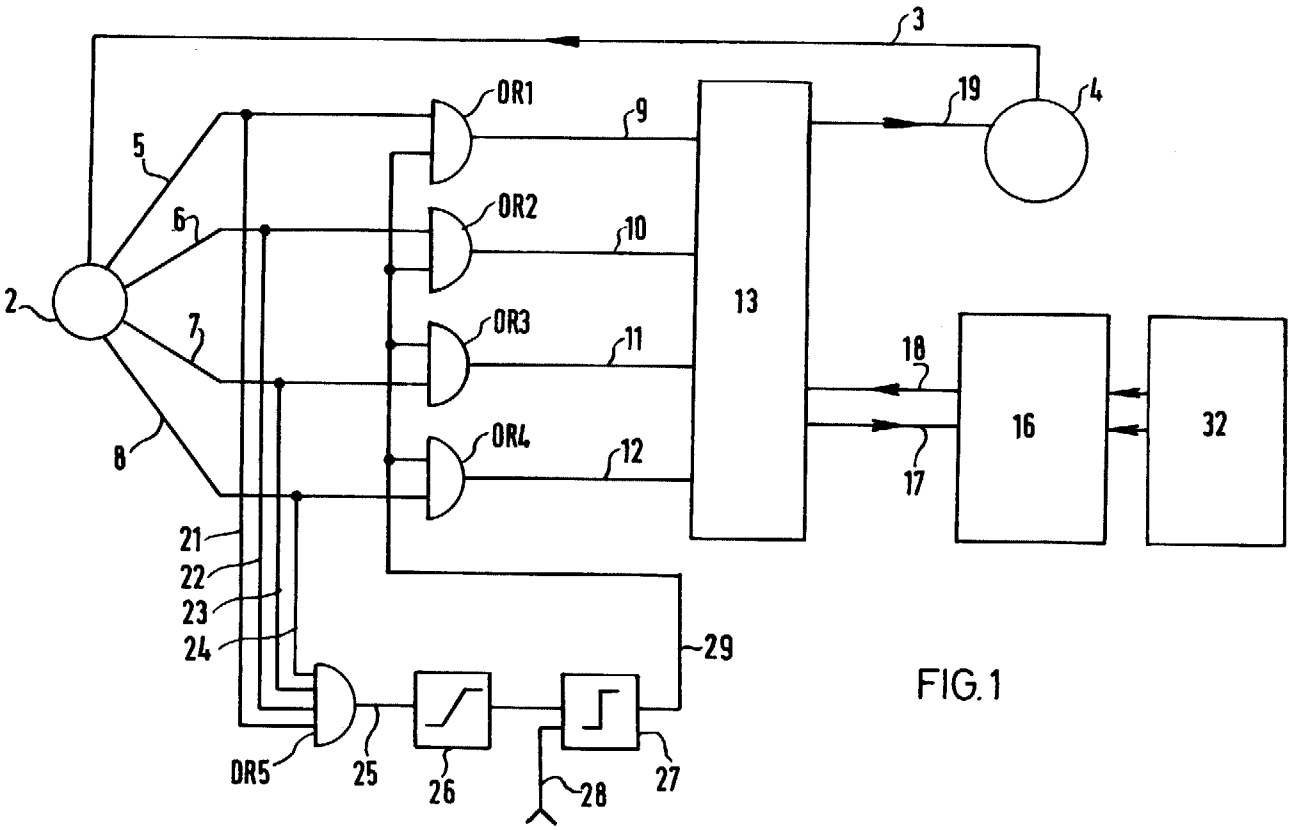
FIG. 1 is a combined circuit diagram of a preferred form of patterning control arrangement according to the invention and block diagram of a computer configuration associated with a knitting machine controlled by the control arrangement.

The arrangement provided by the present invention may incorporate a pattern input facility 32, shown diagrammatically in FIG. 1, and may also be provided with display and pattern amendment means, not shown.

The details of the knitting machine given herein are, of course, only by way of example and any suitable combination of number of needles, yarn feed localities, and numbers of actuators in each stack thereof may be used. Also, the patterning butts may be provided on the needles or any other intermediate needle control element.

Various modifications may be made within the scope of the invention.

I claim:

1. In a patterning control arrangement for multi-feed knitting machines of the type comprising a needle cylinder having needles accommodated in tricks therein, individually selectable patterning butts on or associated with each needle, the said patterning butts being divided into groups at spaced heightwise locations in relation to the needle tricks, and a number, equal to the number of groups, of pattern control means at each feed station with each pattern control means at a station being cooperable with the patterning butts of one group to engage or miss those butts whereby to control the operation of the associated needle wherein the pattern control means each includes an electromagnetically-operated actuator controlled by circuitry arranged to provide operating pulses for the actuator in response to triggering pulses, wherein the improvement comprises that the circuitry is responsive to a specified one of the positive-going or negative-going edges of the triggering pulses to initiate the operating pulses, and inverter means for effectively inverting the triggering pulses at a predetermined speed of operation of the machine whereby the operating pulses are produced in response to the completion of the triggering pulses at operating speeds below the predetermined speed, and in response to the initiation of the triggering pulses at higher operating speeds.

2. A patterning control arrangement as claimed in claim 1, in which the inverter means is arranged to invert the triggering pulses.

3. A patterning control arrangement as claimed in claim 1, in which the operating pulses commence at said higher operating speeds when the actuator is opposite an associated patterning butt, and in which the operating pulses commence at said operating speeds below said predetermined speed after the patterning butt has cleared the actuator.

4. A patterning control arrangement as claimed in claim 1, in which the triggering pulses are provided by a generator means for providing a fixed length triggering pulse for each actuator in timed relation to the speed of the machine.

5. A patterning control arrangement as claimed in claim 1, in which the inverter means includes an exclusive OR gate associated with each actuator and an intermediate circuit arrangement producing a signal when the speed of rotation of the machine exceeds a predetermined threshold level, the said exclusive OR gates receiving as inputs the triggering pulses and the signal from the intermediate circuit and being arranged to transmit an actuating pulse of one polarity in response to receipt of a triggering pulse in the absence of an output from the intermediate circuit, and is to transmit an actuating pulse of the opposite polarity in response to receipt of a triggering pulse in conjunction with an output from the intermediate circuit.

6. A patterning control arrangement as claimed in claim 5, in which the intermediate circuit comprises an OR gate input to an integrator and a trigger circuit responsive to the machine speed to generate an output only at machine speeds above a threshold.

7. A patterning control arrangement as claimed in claim 6, in which the intermediate circuit includes means for producing a hysteresis effect.

8. A patterning control arrangement as claimed in claim 5, in which the machine is controlled by a computer configuration and wherein the circuitry includes a control interface whereby pattern input information from the computer configuration may be routed to the actuators of a knitting machine in accordance with the pulses received from the exclusive OR gates.

9. A patterning control arrangement as claimed in claim 8 in which the control interface is operatively responsive to positive-going edges of the pulses from the exclusive OR gates.

* * * * *